US005524461A

United States Patent [19]

Nielsen et al.

[11] Patent Number: 5,524,461

[45] Date of Patent: Jun. 11, 1996

[54] CONTROL SYSTEM FOR YARN FEED GEARBOX

[75] Inventors: J. Arne Nielsen, Oak Ridge; Majid N. Moghaddassi, Greensboro, both of N.C.

[73] Assignee: Techno-Craft, Inc., Greensboro, N.C.

[21] Appl. No.: 426,969

[22] Filed: Apr. 24, 1995

[51] Int. Cl.[6] ..... D04B 27/10; D04B 27/22

[52] U.S. Cl. ..... 66/210; 66/212; 139/105

[58] Field of Search ..... 66/209, 210, 212; 139/105

[56] References Cited

U.S. PATENT DOCUMENTS

| | | | |
|---|---|---|---|
| 3,626,725 | 12/1971 | Fertig et al. | 66/86 |
| 3,630,052 | 12/1971 | Fertig et al. | 66/86 |
| 3,727,033 | 4/1973 | Bassist | 66/209 X |
| 3,780,541 | 12/1973 | Haynes | 66/210 X |
| 3,961,500 | 6/1976 | Braley et al. | 66/210 |
| 4,426,856 | 1/1984 | Winter et al. | 66/212 |
| 4,554,951 | 11/1985 | Hirano et al. | 139/105 |
| 4,884,597 | 12/1989 | Tamura et al. | 139/102 |
| 5,069,257 | 12/1991 | Borisch | 139/99 |
| 5,152,158 | 10/1992 | Wirth | 66/212 |
| 5,163,307 | 11/1992 | Jahn et al. | 66/212 |
| 5,176,010 | 1/1993 | Wirth et al. | 66/212 |
| 5,375,435 | 12/1994 | Gille et al. | 66/211 |

FOREIGN PATENT DOCUMENTS

| | | | |
|---|---|---|---|
| 2307152 | 8/1973 | Germany | 66/212 |
| 821576 | 4/1981 | U.S.S.R. | 66/212 |
| 1687671 | 10/1991 | U.S.S.R. | 66/210 |
| 2253862 | 9/1992 | United Kingdom | 66/210 |

OTHER PUBLICATIONS

Manual For Mayer Knitting Machine, RE4–6,N (1965) pp. 22–33.

Kyodo Denshi Kogyo Co., Ltd.; Electronic Yarn Control Device Instruction Manual. Admitted Prior Art.

*Primary Examiner*—John J. Calvert

*Attorney, Agent, or Firm*—Rhodes, Coats & Bennett

[57] ABSTRACT

A yarn feed gearbox control system for controlling the let-off speed of a yarn feed gearbox. The control system is adapted for use with a warp knitting machine having a main shaft and a gearbox operative to control the feed rate of yarn delivery from a yarn beam, the gearbox including an adjustment spindle extending therefrom. The control system includes a yarn feed rate detector which measures the rate of yarn delivery from the beam, a computer which receives yarn feed rate signals from the yarn feed rate detector and generates control signals corresponding thereto, and a control device which controls the speed of rotation of the spindle in accordance with the control signals. The control system may be further provided with a main shaft detector to measure the speed of rotation of the main shaft of the knitting machine. The control system may also be provided with a beam revolution detector to generate a revolution signal corresponding to each revolution of the yarn beam. Signals from the beam revolution detector may be utilized to control the actuation of an alarm and/or to stop the knitting machine. The yarn feed rate detector preferably includes a two roller assembly.

20 Claims, 4 Drawing Sheets

CONTROL SYSTEM FOR YARN FEED GEARBOX

FIELD OF THE INVENTION

The present invention is directed to feedback control means for controlling the operation of yarn feed gearboxes, and more particularly, to an electromechanical feedback control means for monitoring and controlling a stepless warp knitting machine yarn feed gearbox.

BACKGROUND OF THE INVENTION

In warp knitting operations it is of critical importance that the feed yarn be delivered from a yarn beam at a prescribed rate. Otherwise, the yarn may be overslacked or overtensioned, causing defects and yarn breakage. Therefore, the rotational speed of the yarn beam must be carefully controlled to insure an appropriate rate of yarn feed. Controlling yarn delivery is complicated by the nature of the delivery mechanism, i.e., a linear, overlapped yarn being unwound from a cylindrical beam. As yarn is taken off of the beam, the effective diameter of the beam is reduced and, as a result, less yarn is delivered per revolution of the beam. Thus, in order to maintain a constant rate of delivery, it is necessary to increase the rotational speed of the beam in accordance with the reduction in beam diameter.

Devices have been developed to compensate for the dynamically decreasing beam diameter as discussed above. One such compensation device in wide use is the stepless variable cone gear let-off. Let-offs of this type function as continuously variable gearboxes for adjusting the gear ratio between the yarn beam drive means and the yarn beam. Adjustment is accomplished by adjusting the speed of a spindle extending from the let-off. If no force acts on the spindle and it is allowed to spin freely, then the gear ratio remains constant and the beam speed is not altered. The gear ratio and, thus, the speed of the beam are increased if the speed of the spindle is increased by an external drive means. The gear ratio and, thus, the speed of the beam are decreased if the speed of the spindle is decreased by an external drive means or inhibitor. After the gear ratio has been adjusted by manipulation of the spindle as discussed above such that beam speed and beam diameter result in a prescribed yarn delivery rate, the spindle is again allowed to spin freely until another adjustment needs to be made. A more detailed discussion of the operation and construction of a stepless variable cone gear let-off is discussed below in the detailed description of the preferred embodiment.

In order to provide feedback between the yarn beam and the let-off, mechanical control and feedback means have been implemented. Such means typically include a measuring arm having a roller in contact with the yarn on the beam. As the beam turns, the roller turns at the rate of travel of the yarn surface which is the same as the rate of the yarn delivery. A mechanical linkage, typically comprising chains and pulleys, connects the roller to the aforementioned spindle. When the rotation rate of the roller exceeds that of the spindle, the spindle speed is increased. When the rotation rate of the roller is less than that of the spindle, the spindle speed is inhibited.

Mechanical control and feedback means as described above suffer from several significant drawbacks. Because the entire feedback system is mechanical, it is prone to wander from its original settings, requiring periodic checks and readjustments. Further, if the roller is fomed of metal or some other hard and durable material, it tends to slip on the yarn, providing inaccurate feedback. If the roller is made from rubber or similar material, it tends to wear down, resulting in a smaller diameter roller and, again, inaccurate feedback. Moreover, the mechanical linkage typically includes a chain and a geared pulley affixed to the spindle. In the knitting environment, there exists a tendency for fiber, dust, and yarn remnants to accumulate about the chain and gear pulley. Thus, the mechanical linkage must be periodically cleaned. Such mechanical feedback means do not lend themselves to convenient modification of settings.

Thus, there exists a need for a more reliable means for controlling stepless variable cone gear let-offs which overcomes the deficiencies in accuracy, maintainability, and variability of the mechanical feedback means of the prior art.

SUMMARY OF THE INVENTION

The present invention is directed to a yarn feed gearbox control system for use with a warp knitting machine of the type having a main shaft or cam shaft and operative to control the let-off speed of a yarn feed gearbox. The gearbox, which may be of conventional construction, controls the rate of yarn delivery from a yarn beam and includes an adjustment spindle extending therefrom. The control system includes a yarn feed rate detector which measures the rate of yarn delivery from the beam. The control system also includes a computer which receives yarn feed rate signals from the yarn feed rate detector and generates control signals corresponding to the yarn feed rate signals. A control device forming a part of the control system controls the speed of rotation of the spindle in accordance with the aforementioned control signals.

Preferably, the yarn feed rate detector includes a first roller, at least one magnet mounted on the first roller, and a roller sensor mounted adjacent the first roller and which generates a roller signal in response to the presence of the magnet adjacent the roller sensor. More preferably, the yarn feed rate detector is further provided with a second roller. The second roller maintains frictional contact with the yarn on the beam such that it rotates as yarn is delivered. The aforementioned first roller is maintained in contact with the second roller such that as the second roller rotates, the first roller rotates at the speed of yarn delivery from the beam. Preferably, the first roller is formed from a wear-resistant material and the second roller is formed from a high friction material. This configuration allows the use of a rubber roller in contact with the yarn without sacrificing accuracy due to wear of the rubber roller.

The above-described control device is preferably a torque motor. Moreover, the control device may further include a drive gear mounted on the torque motor for rotation therewith, a driven gear mounted on the spindle for rotation therewith, the drive gear and the driven gear being intermeshed.

The control system may be further provided with a main shaft detector which measures the speed of rotation of the main shaft. The computer receives main shaft speed signals from the main shaft detector and generates the aforementioned control signals in accordance with the main shaft speed signals. Moreover, the computer may further include a counter to count the pulses generated by the main shaft detector.

The control system may be further provided with a beam revolution detector for generating a revolution signal corresponding to each revolution of the yarn beam. Pulses generated by the beam revolution detector are received and counted or used to decrement from a set point by the computer. The computer may then control the actuation of the knitting machine and/or alarms in accordance with the number of pulses (i.e., the number of revolutions of the beam) received.

An object of the present invention is to provide a yarn feed gearbox control system which overcomes the deficiencies of mechanical feedback gearbox control systems according to the prior art. Namely, it is an object of the present invention to provide a gearbox control system which achieves enhanced accuracy, maintainability, and variability.

A primary object of the present invention is to provide a computer control and monitoring device for conventional stepless knitting machine yarn feed gearboxes.

An object of the present invention is to provide such a control system for gearboxes which utilizes a torque motor operable to increase or decrease the speed of a spindle forming a part of the gearbox.

An object of the present invention is to provide such a gearbox control system having electronic means for measuring the rate of yarn delivery.

Moreover, an object of the present invention is to provide a control system as described above including electronic means for monitoring the number of revolutions of the yarn beam and a computer operable to present an alarm in response to a prescribed number of revolutions.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENT

Figure 1:
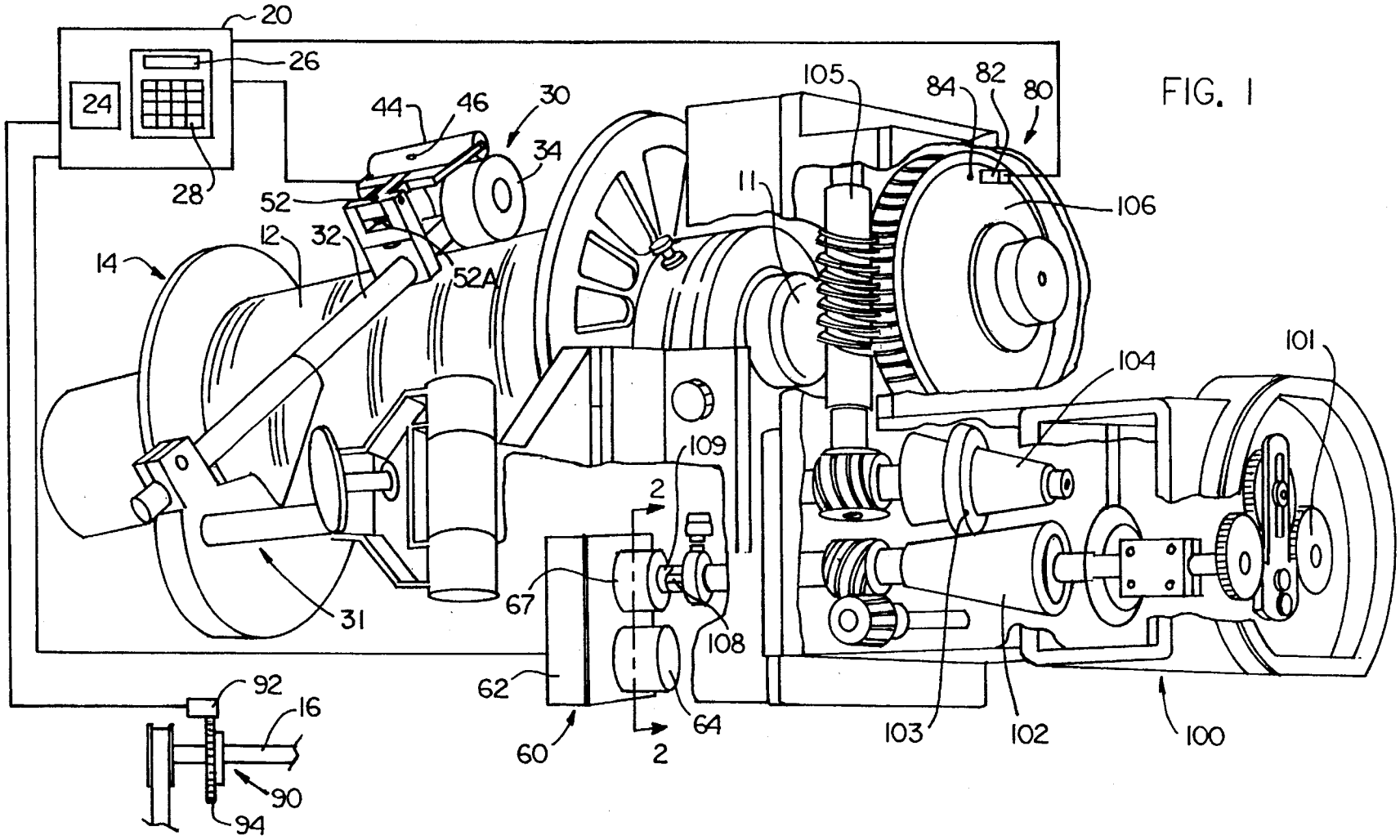
FIG. 1 is a fragmentary perspective view of the control system according to the present invention shown mounted on and as used with a conventional stepless variable cone gear let-off, yarn beam, and knitting machine.

With reference to FIG. 1, a control system 10 according to the present invention is shown therein mounted on a let-off 100 and a yarn beam 14. Control system 10 serves in conjunction with let-off 100 to control the rate of delivery of yarn 12 from beam 14. Let-off 100 may be, for example, as provided on a Mayer knitting machine.

With further reference to FIG. 1, conventional let-off 100 is driven by means of change gear 101 which drives bevel cone 102. Second cone 104, which is driven by friction ring 103, drives worm shaft 105 and worm wheel 106. Worm wheel 106 is connected to the support of beam shaft 11. If the speeds of measuring spindle 108 (which rotates within housing 109) and the worm differ from each other, pawls (not shown) move vertically and turn a ratchet wheel (not shown) in a preselected direction. The ratchet wheel is connected to a thread spindle (not shown) on which friction ring 103 is situated. The thread spindle revolves with the ratchet wheel and moves friction ring 103 along between cones 102,104. The ratio in the cone gear is, therefore, altered. As a result, beam shaft 11 turns slower or faster. Beam 14 is fixedly secured to beam shaft 11 and turns therewith. When the speeds of measuring spindle 108 and the worm are the same, the pawls return to their central position, and no further adjustment takes place. Let-offs as described above are well-known and their operation will be understood by those of ordinary skill in the art.

Control system 10 functions to measure the rate of yarn delivery from beam 14, compare the rate of yarn delivery with a desired rate, and adjust the speed of spindle 108 in a manner causing let-off 100 to adjust the rotational speed of beam shaft 11 (and, thus, beam 14) as needed. The yarn delivery rate measuring function of control system 10 is accomplished by roller detector 30 and main shaft detector 90. The desired settings are prescribed via input means or keypad 28 of computer 20. The comparative function of control system 10 is accomplished by central processing unit (CPU) 22 of computer 20. Control signals corresponding to such comparisons are received and implemented by control device 60 which serves to increase or decrease the rotational speed of spindle 108. Beam revolution detector 80 is provided to allow the operator to monitor the number of revolutions of beam 14 and to allow for preset events corresponding to the number of revolutions.

Figure 3:
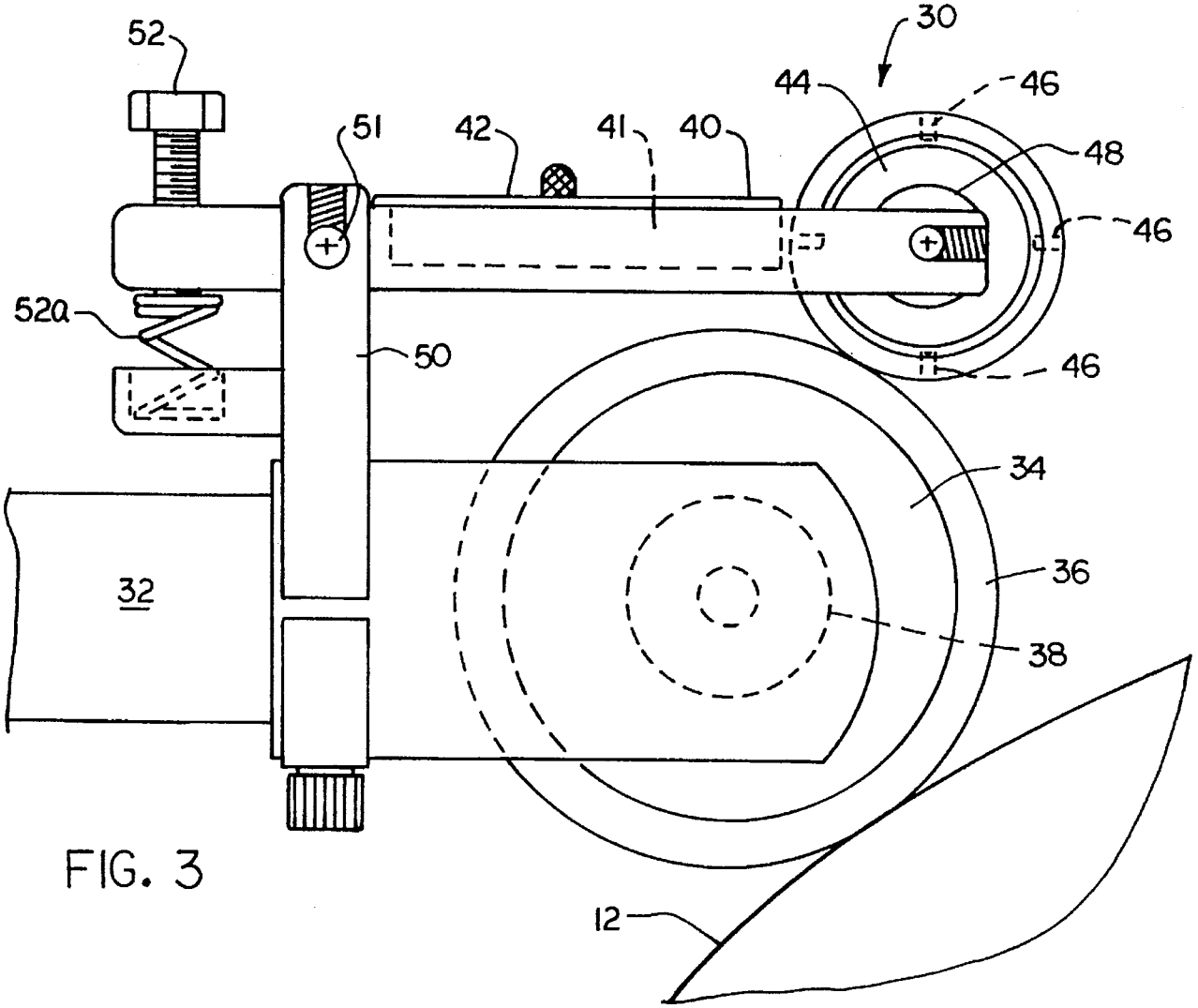
FIG. 3 is a side elevational view of the roller detector forming a part of the present invention, shown resting on a yarn beam.

As best seen in FIGS. 1 and 3, roller detector 30 serves to measure the actual speed of yarn delivered from beam 14. Primary support arm 32 is preferably adjustably secured to the frame or wall of the knitting machine by support assembly 31 and is thereby held in contact with yarn 12 on beam 14. Doughnut shaped primary roller 34 is rotatably mounted on primary support arm 32 by bearings 38 on either end thereof. Support bracket 50 extends upwardly from primary support arm 32, and secondary support arm 42 is mounted thereon such that secondary support arm 42 may pivot about pin 51. Secondary roller 44 is mounted by means of bearings 48 on the end of secondary support arm 42 opposite support bracket 50. Secondary roller 44 is held in firm contact with primary roller 34 by the biasing arrangement of screw 52, spring **52*a* and platform 53. Magnets 46 are imbedded in roller 44 such that as they rotate about bearings 48, they pass adjacent hall effect sensor 40 mounted in cavity 41 formed in secondary support arm 42 proximate the periphery of roller 44. Hall effect sensor 40 is electrically connected (not shown) to computer 20. Hall effect sensor 40** may be, by way of example, product number UGN 3140U/A3142EU available from Allegro Microsystems, Inc.

Secondary roller 44 is preferably formed from a hard, wear resistant material such as aluminum. Primary roller 34 preferably has a rubber coating or sleeve 36. Rubber coating or sleeve 36 serves to enhance frictional contact between primary roller 34 and yarn 12, thereby reducing slippage therebetween. The rate of rotation of secondary roller 44 corresponds directly to the rate of delivery of yarn 12, regardless of the diameter of primary roller 34. Therefore, the wear of rubber coating or sleeve 36 and the resulting dimunition in diameter will not affect the accuracy of the measurements of roller detector 30. To further reduce slippage, roller detector 30 preferably includes two coaxial, side-by-side primary rollers 34 with a single, relatively long secondary roller 44 overlaying and in contact with both primary rollers 34.

An encoder may be used in place of hall effect sensor 40 and magnets 46 of roller detector 30.

As best seen in FIG. 1, main shaft detector 90 includes gear 94 fixedly mounted on main shaft or cam shaft 16 of the knitting machine. Hall effect sensor 92 is mounted over a peripheral edge of gear 94 and serves to count the teeth of gear 94 as they rotate past hall effect sensor 92. Hall effect sensor 92 is preferably a differential hall effect sensor having a permanent magnet mounted on the back of sensor 92 (i.e., on the side of sensor 92 opposite gear 94). Hall effect sensor 92 may be, for example, product number A3056EU available from Allegro Microsystems, Inc. Hall effect sensor 92 distinguishes between the valleys and peaks of gear 94 by measuring the flux across hall effect sensor 92. This flux is lesser than nominal for the valleys and greater than nominal for the peaks. For each peak or valley of gear 94 which passes by sensor 92, sensor 92 generates a pulse which is received by counter 24 of computer 20. Preferably, gear 94 has one hundred twenty or more teeth to provide higher resolution to the process as described below. It will be appreciated that because each turn of main shaft 16 results in a single needle stitch of the knitting machine, if gear 94 has one hundred twenty teeth, hall effect sensor 92 will generate one hundred twenty pulses for each needle stitch.

As best seen in FIG. 1, beam revolution detector 80 includes permanent magnet 84 embedded in worm wheel 106 and hall effect sensor 82 mounted adjacent worm wheel 106 such that as beam 14 rotates, magnet 84 passes by sensor 82. With each such occurrence, hall effect sensor 82 generates a pulse which is received by computer 20. Each pulse thereby corresponds to a single, complete revolution of beam 14. In this way, computer 20 is able to monitor and count the number of revolutions of beam 14 over a given period of time and compare the count with a given set point.

Figure 2:
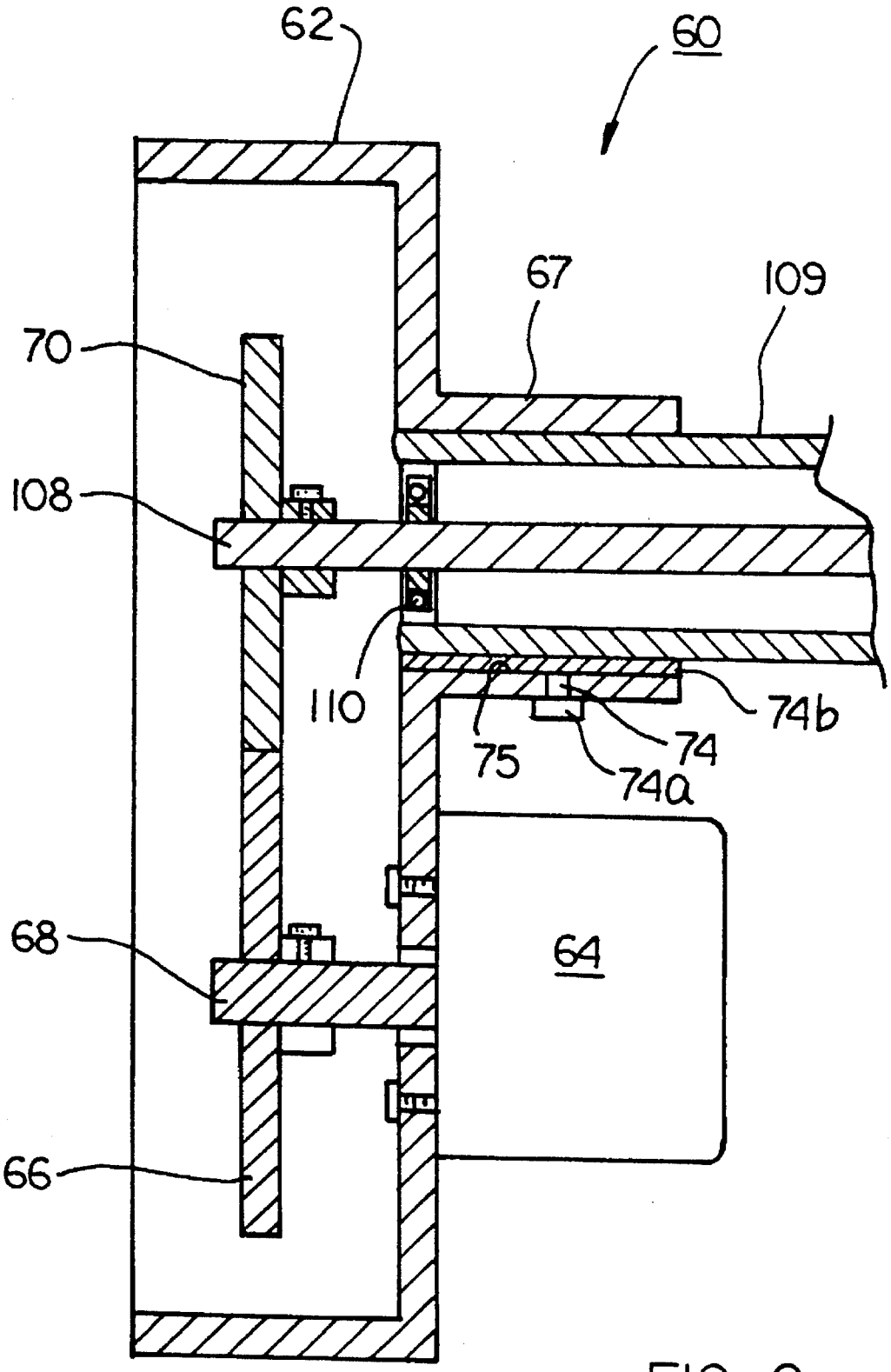
FIG. 2 is a fragmentary, side cross sectional view of the control device forming a part of the control system of the present invention.

As best seen in FIGS. 1 and 2, control device 60 includes case 62 which houses torque motor 64, drive gear 66, motor shaft 68, and driven gear 70. Case 62 includes tubular housing 67 which is adapted to receive spindle housing 109. Housing 109 is secured within housing 67 by means of key slot 75 and threaded bore 74, each of which are formed in housing 67, and key stock **74*b* and set screw 74*a*. More particularly, set screw 74*a* is tightened down, thereby driving key stock 74*b* into frictional engagement with the outer surface of housing 109. Preferably, an identical arrangement (not shown) is provided at a position on housing 67 radially offset from that shown in FIG. 2 by 90°. Spindle 108 extends through housing 67 and housing 109 and into case 62. Alignment of spindle 108 is maintained by bearings 110. Motor shaft 68 extends from torque motor 64 and drive gear 66 is fixedly mounted thereon. Driven gear 70 is secured to the end of spindle 108 and is intermeshed with drive gear 66**.

Torque motor 64 preferably has low friction so that when it is in idle mode (i.e., turned off), it does not load spindle 108, but has enough available torque and speed so that when it is energized it is able to offset the spindle speed in either direction. Suitable motors include torque motor product number 3TK6A-AULA available from Oriental Motor Co. of Japan. To further reduce the load of torque motor 64 on spindle 108 when torque motor 64 is idling, a 0.8:1 step down gear ratio (for example, drive gear 66 being a sixty tooth gear and driven gear 70 being a forty-eight tooth gear) may be selected with gears 66,70 loosely matched.

Figure 4:
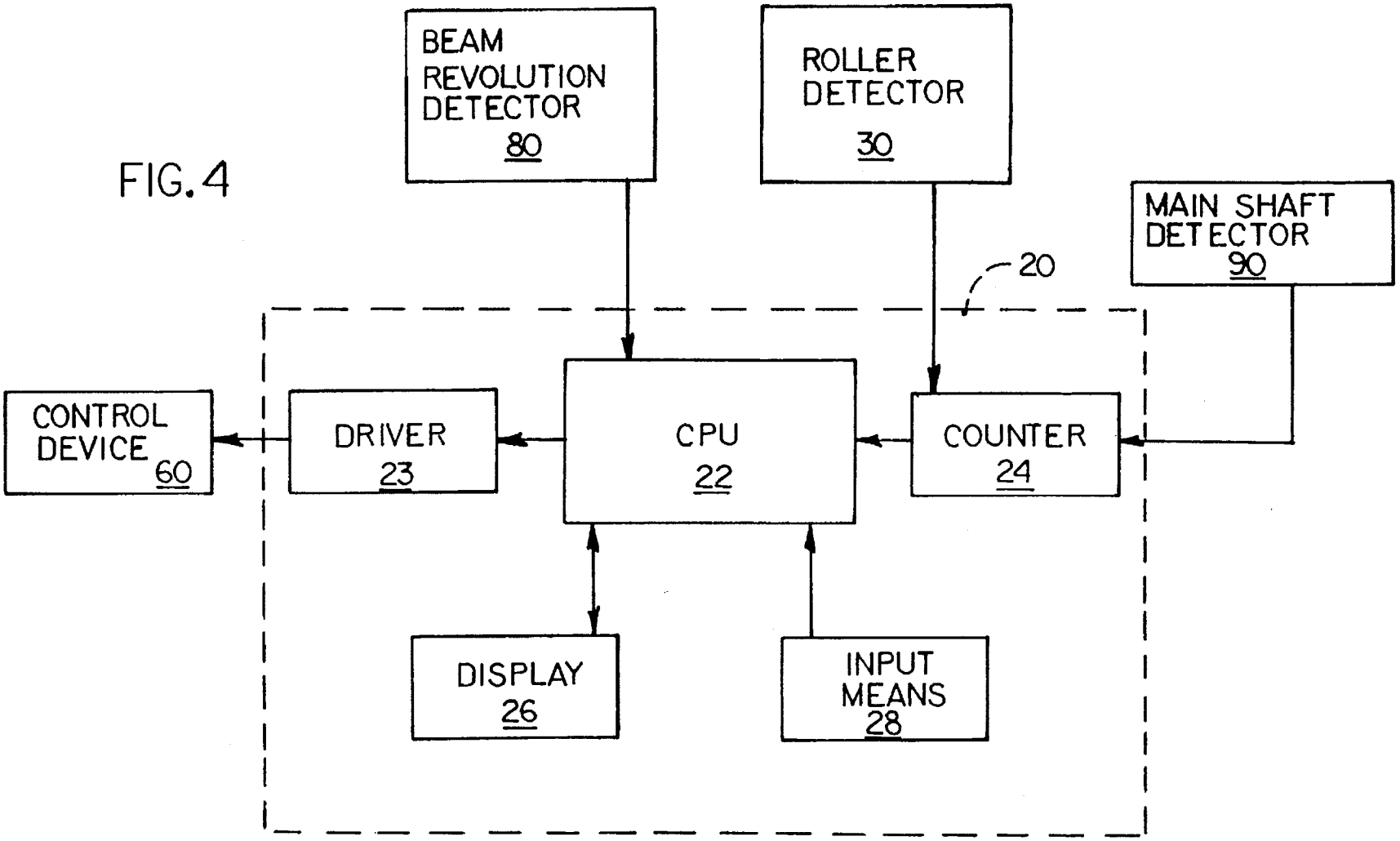
FIG. 4 is a schematic block diagram of the yarn feed gearbox control system according to the present invention.

As noted above, computer 20 includes CPU 22 and counter 24. Computer 20 is further provided with conventional display 26 and input means 28, preferably including a keypad. With reference to FIG. 4, CPU 22 receives pulses generated from roller detector 30, beam revolution detector 80, and main shaft detector 90, the pulses from main shaft detector 90 first being counted by counter 24. CPU 22 further receives input from input means 28. Computer 20 outputs to display 26 and control device 60. More particularly, computer 20 generates signals via driver 23 to control device 60 causing torque motor 64 to provide drive force in a reverse or forward direction in accordance with the operation discussed below. Driver 23 may be, For example, a triac.

The control system of the present invention may be utilized as follows. The machine operator first inputs a reference point value representing the desired inches of yarn to be delivered per rack of the knitting machine. Such values are typically known for a given fabric and stitch pattern and are conventionally expressed in terms of inches per rack. One rack is equal to 480 stitches of the knitting machine.

As yarn is delivered from beam 14, primary roller 34 in contact with yarn 12 rotates, in turn causing secondary roller 44 to rotate. As secondary roller 44 rotates, hall effect sensor 40 generates a pulse to computer 20 for each given length of yarn delivered from beam 14 (e.g., 1.2 inches per pulse). For each revolution of main shaft or cam shaft 16, hall effect sensor 92 generates a given number of pulses to counter 24 (e.g., one hundred twenty pulses per revolution or stitch). For each pulse from sensor 40, CPU 22 inputs from counter 24 the number of pulses from sensor 92 received since the last pulse received from sensor 40 and resets the counter. Because the inches per pulse of sensor 40 and revolutions per pulse of sensor 92 are known constants, CPU 22 is able to calculate the essentially instantaneous rate of yarn delivery in inches per rack.

More particularly, the actual yarn delivery rate (inches per rack) may be determined according to the following equation:

$$\text{yarn delivery rate} = \frac{OD_r * R * P_{REV} * \pi}{P_c * N_r}$$

where $OD_r$ is the outside diameter (inches) of roller 44;

R is the number of revolutions of the main shaft per rack;

$P_{REV}$ is the number of pulses per revolution of main shaft 16;

$P_c$ is the pulse count from counter 24 at the time of a given pulse from sensor 40 (pulses); and $N_r$ is the number of magnets on roller 44.

For each pulse of sensor 40, after calculating the current inches per rack value, CPU 22 compares the measured inches per rack with the previously input reference point inches per rack. If the measured inches per rack and the reference point inches per rack are different and the deviation exceeds a prescribed amount, computer 20 actuates motor 64 to provide torque in a direction appropriate to offset the speed of spindle 108 and thereby control let-off 100. (It will be appreciated that when motor 64 is actuated in a reverse direction against the rotation of spindle 108, the rotation of spindle 108 typically will be held or inhibited rather than reversed.) Control system 10 thereby readjusts the speed of beam 14 until the measured inches per rack match or fall within a prescribed range of deviation from the reference point inches per rack. Once the measured inches per rack are the same as or close enough to the reference point inches per rack, computer 20 deactuates motor 64, allowing driven gear 70 to spin freely such that there is no offset effect on spindle 108. Beam 14 then maintains the current speed.

The preferred amount of deviation between the reference value and the measured value triggering actuation and deactuation of motor 64 is in the range of −0.1 to +0.1 inches per rack.

Control system 10 also includes an alarm function and an automatic stop function. The operator may input at input means 28 a set point number of revolutions of beam 14 which he or she would like to occur prior to actuation of the alarm and/or automatic stop functions. The operator may at this time request either the sounding of an alarm or flashing of a display after the set number of revolutions has occurred. The operator may also request that the knitting machine automatically stop after a set number of revolutions of beam 14. Any combination of the above operations may be chosen as well. Computer 20 receives and counts pulses from hall effect sensor 82, each of the pulses corresponding to a revolution of beam 14. When the number of counted pulses equals the set point number or numbers, computer 20 actuates the desired function. Alternatively, computer 20 may count down from the operator set point, decrementing upon receiving each pulse from sensor 82. Computer 20 may also simply display this information so that the operator can read at any given time the number of revolutions of beam 14 which have occurred. Moreover, each of the above functions may be automatically implemented, not requiring the operator to input any set points.

The present invention may, of course, be carried out in other specific ways than herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A yarn feed gearbox control system for controlling a let-off speed of a yarn feed gearbox, the gearbox operative to control a rate of yarn delivery from a yarn beam and including an adjustment spindle extending therefrom, said control system for use with a warp knitting machine having a main shaft and comprising:

a) a yarn feed rate detector operative to measure the rate of yarn delivery from the beam and generate yarn feed rate signals;

b) a computer operative to receive yarn feed rate signals from said yarn feed rate detector and to generate electrical control signals corresponding to said yarn feed rate signals;

c) a control device operative to control a speed rotation of the adjustment spindle in accordance with said control signals; and d) a beam revolution detector operative to generate a revolution signal corresponding to each revolution of the yarn beam.

2. The control system of claim 1 further including a main shaft detector operative to measure a speed of rotation of the main shaft of the knitting machine, and wherein said computer is operative to receive main shaft speed signals from said main shaft detector and to generate said control signals in accordance with said main shaft speed signals.

3. The control system of claim 2 wherein said main shaft detector includes a gear having a plurality of teeth and mounted on the main shaft and a shaft sensor operative to generate pulses when said teeth pass by said shaft sensor.

4. The control system of claim 3 wherein said computer further includes a counter operative to count said pulses generated by said shaft sensor.

5. The control system of claim 1 wherein said beam revolution detector includes a magnet mounted on said beam for rotation therewith and a beam sensor such that said beam sensor generates a pulse for each revolution of the beam.

6. The control system of claim 5 wherein said computer further includes input means and an alarm, and wherein said computer actuates said alarm when a sum of said pulses generated by said beam sensor satisfies a prescribed relationship with a number input using said input means.

7. The control system of claim 6 wherein said computer further includes a display operable to display a number of beam pulses generated by said beam sensor.

8. The control system of claim 1 wherein said yarn feed rate detector includes:

a) a first roller arranged and configured to rotate at a rate proportional to the rate of yarn delivered from the beam;

b) at least one magnet mounted on said first roller; and c) a roller sensor mounted adjacent said first roller and operative to generate a roller signal in response to the presence of said magnet adjacent of said roller sensor.

9. The control system of claim 8 herein said yarn feed rate detector further includes a second roller, wherein said second roller is in contact with the yarn on the beam and is operative to roll in response to the movement of the yarn, wherein said first roller is in contact with said second roller such that as said second roller rotates said first roller rotates at the rate of yarn delivery from the beam.

10. The control system of claim 9 wherein said second roller has a rubber outer surface.

11. The control system of claim 1 wherein said computer includes:

a) a central processing unit;

b) a display electrically connected with said central processing unit; and c) input means electrically connected with said central processing unit.

12. The control system of claim 11 wherein said input means includes a keypad.

13. The control system of claim 1 wherein said control device includes a torque motor.

14. The control system of claim 13 wherein said control device further includes a drive gear mounted on said torque motor for rotation therewith, a driven gear mounted on the spindle for rotation therewith, and wherein said driven gear and said drive gear are intermeshed.

15. A yarn feed gearbox control system for controlling a let-off rate of a yarn feed gearbox, the gearbox operative to control a rate of yarn delivery from a yarn beam and including an adjustment spindle extending therefrom, said control system for use with a warp knitting machine having a main shaft and comprising:

a) a yarn feed rate detector operative to measure the rate of yarn delivery from the beam and operative to generate yarn feed rate pulses at a rate proportional to the rate of yarn delivery from the beam;

b) a main shaft detector operative to generate main shaft speed signals at a rate proportional to a speed of rotation of the main shall of the knitting machine;

c) a computer operative to receive said yarn feed rate pulses from said yarn feed rate detector and to receive said main shaft speed pulses from said main shaft detector, said computer including a counter operative to count the number of main shaft speed pulses between respective yarn feed rate pulses, said computer operative to generate control signals corresponding to the value in said counter for each yarn feed rate pulse received from said yarn feed rate detector;

d) a control device operative to control a speed of rotation of the spindle in accordance with said control signals; and e) a beam revolution detector operative to generate a revolution signal corresponding to each revolution of the yarn beam.

16. The control system of claim 15 wherein said yarn feed rate detector includes:

a) a first roller arranged and configured to rotate at a rate proportional to the rate of yarn delivery from the beam;

b) at least one magnet mounted on said first roller; and c) a roller sensor mounted adjacent said first roller and operative to generate a roller signal in response to the presence of said magnet adjacent said roller sensor.

17. The control system of claim 16 wherein said yarn feed rate detector further includes a second roller, wherein said second roller is in contact with the yarn on the beam and is operative to roll in response to the movement of the yarn, wherein said first roller is in contact with said second roller such that as said second roller rotates said first roller rotates at the rate of yarn delivery from the beam.

18. A yarn feed control system for monitoring delivery of yarn from a yarn beam, said control system comprising:

a) a beam revolution detector operative to generate revolution signals corresponding to each revolution of the yarn beam;

b) a computer operative to receive said revolution signals and to actuate an output means in response to said revolution signals; and c) wherein said beam revolution detector includes a magnet mounted on the yarn beam for rotation therewith and a beam sensor such that said beam sensor generates a pulse for each revolution of the yarn beam.

19. The control system of claim 18 wherein said computer further includes input means and an alarm, and wherein said computer actuates said alarm when a sum of said pulses generated by said beam sensor satisfies a prescribed relationship with a number input using an input means forming a part of said computer.

20. The control system or claim 19 wherein said computer further includes a display operable to display a number of beam pulses generated by said beam sensor.

* * * * *